United States Patent [19]

Perkins

[11] 4,067,680

[45] Jan. 10, 1978

[54] TROWEL FOR PIPE LINING MATERIAL

[76] Inventor: Alfred G. Perkins, 1000 Porterville Road, East Aurora, N.Y. 14052

[21] Appl. No.: 751,843

[22] Filed: Dec. 17, 1976

[51] Int. Cl.[2] ..... B28B 7/32

[52] U.S. Cl. ..... 425/460; 118/105; 425/262

[58] Field of Search ..... 425/95, 262, 460, 469; 249/65; 118/105; 264/269, 270

[56] References Cited

U.S. PATENT DOCUMENTS

| | | | |
|---|---|---|---|
| 2,324,554 | 7/1943 | Billner | 249/65 |
| 3,966,389 | 6/1976 | Shubert | 425/262 |
| 3,990,830 | 11/1976 | Slade | 425/262 |

*Primary Examiner*—Francis S. Husar
*Assistant Examiner*—John McQuade
*Attorney, Agent, or Firm*—Christel & Bean

[57] ABSTRACT

The invention relates to a frustoconical drag trowel which is drawn through a pipe or the like to trowel a layer of mortar or other plastic lining material therein. The frustoconical trowel has a small leading end of relatively fixed diameter and a large trailing end which is adapted to be expanded and contracted in a diametral direction. The present disclosure provides a novel means within the large end of the trowel for exerting a resilient expansive force thereagainst. This means comprises a hollow torus adapted to bear against the interior of the large end of the trowel along the perimeter of the torus. The torus is of elastic material but is provided with a winding thereabout for restaining the torus against expansion in the direction of its cross-sectional diameter whereby fluid pressure within the torus causes the same to exert an expansive force in the direction of its circumference and thus urge the large end of the trowel body diametrally outwardly to exert a resilient expansive force within the large end of the trowel.

8 Claims, 6 Drawing Figures

TROWEL FOR PIPE LINING MATERIAL

BACKGROUND OF THE INVENTION

This invention relates to pipe lining apparatus wherein a protective coating of mortar or similar material in plastic condition is applied to the interior of a pipe and more particularly to a troweling means for smoothing the surface of such an interior coating directly after the same has been applied to or deposited against the interior wall of a pipe. Such troweling means are generally known in the art as drag trowels and are usually frustoconical, having small leading ends and larger trailing ends. The trowels are commonly connected to the rear ends of mortar applying machines to be drawn through the pipe thereby.

The prior art contains a number of examples of sheet metal frustoconical trowels for the general purpose of smoothing an interior mortar coating by pulling the trowel through a pipe wherein such mortar has been applied to the interior surface of the pipe. The trowel is drawn through the pipe with its small end first and the large or trailing end of the trowel which performs the mortar-smoothing function is necessarily resilient and must be readily expansible and contractable in a diametral direction while still generally retaining its circular form or tending to maintain such form even though local conditions may cause the large troweling end of the trowel to assume somewhat elliptical or other distorted forms temporarily.

Since trowels of this type are drawn through a pipe under conditions where the operation of the trowel cannot be observed during its functional periods, the necessity for safe, accurate and foolproof operation and self-adjustment for various physical conditions which are encountered by the trowel in its passage through a pipe is of great importance.

The present invention is concerned particularly with the means for applying resilient expansive forces to the large trailing end portions of frustoconical trowels of this general type. A considerable variety of trowel expanding arrangements are found in the prior art. Representative examples will be found in Perkins U.S. Pat. No. 2,924,867 and Ruegsegger U.S. Pat. Nos. 3,257,698 and 3,257,699. It is believed that the closest approach to the trowel expansion means of the present invention is found in Barton U.S. Pat. No. 3,263,296 wherein an expansion coil spring is disposed within the large end of the trowel at and extending across each overlap of the trowel plate or plates for applying expansive forces thereto. Such a coil spring is, by its nature, not readily adjustable as to the expansive force which it exerts and, furthermore, is apt to become fouled by dried mortar so that its operation is not uniform and reliable and may in certain cases be more or less entirely useless by reason of the presence of dried mortar in the coils of the spring or other operating parts.

SUMMARY OF THE INVENTION

The present invention provides a trowel expanding arrangement which is very simple and fool-proof in operation and which lends itself particularly to selective adjustment of the expansive force exerted thereby throughout a very substantial range of expanding forces. Furthermore, the trowel expanding means of the present invention is such that it is substantially free of any liklihood of becoming affected or immobilized by reason of the presence of mortar thereabout.

Stated broadly, the trowel expanding arrangement of the present invention comprises a torus-shaped tubular member of rubber or other elastic material, such as synthetic plastic material of a highly elastomeric nature. The elastic tubular member is wound throughout its length externally with wire or the like to restrict the same against expansion of the transverse diameter of the tubular member under internal fluid pressure forces.

Valve means are provided for applying internal air pressure to the tube to provide expansive forces therein. Due to the external winding, the torus tubular element can expand only in the direction of its length, that is in a direction which is circumferential with respect to the trowel body. Thus, the degree of expanding resilient force exerted by the torus-shaped tubular member is readily and accurately adjustable by increasing or decreasing the internal air pressure therein.

The arrangement of the present invention has the additional very important advantage of applying uniform expansive forces to the large end of the trowel in all radial directions despite the fact that the trowel itself may be flexed to an oval or other non-circular contour due to bends in the pipe being troweled and obstructions which are sometimes encountered therein.

With a given quantity of air in the torus at a certain pressure, the force of the air pressure tending to expand the torus will fall off as the torus expands due to the increased internal volume of the torus. The present invention contemplates means for minimizing or neutralizing this effect. In one embodiment the torus may have connected thereto a pressure storage tank with an open conduit between the interiors of the tank and the torus. This increases the total volume of air under pressure and, accordingly, obviously greatly decreases the fall-off in pressure as the torus expands circumferentially. This reservoir may be located directly within the trowel body or remotely therefrom. In the latter case the connecting conduit extends from the torus to wherever the reservoir is located.

In a further adaptation of the present invention the torus may have fluid pressure connection with a remotely located source of constant or adjustable regulated fluid pressure in which case the unit fluid pressure within the torus may be held substantially constant despite expansion thereof.

DESCRIPTION OF THE ILLUSTRATED EMBODIMENTS

Figure 1:
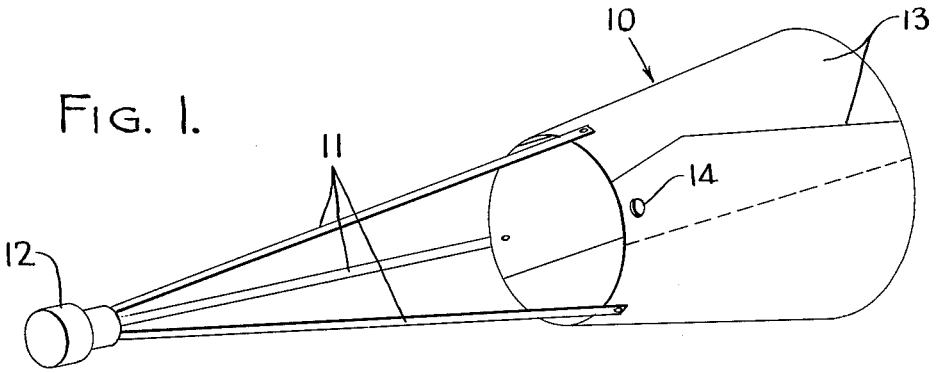
FIG. 1 is a general somewhat schematic perspective view of one form of pipe lining trowel to which the trowel expanding means of the present invention may be applied.

FIG. 1 shows a frustoconical pipe lining trowel of the general type here under consideration. In FIG. 1 the numeral 10 designates generally a sheet metal trowel body having three rods 11 connected to the small end thereof and leading to a swivel member 12 which may be connected to any suitable traction means but is usually connected to a mortar applying machine in a manner which is well known in the pipe lining art. Thus, the trowel is drawn through the interior of a pipe immediately following the application of mortar to such interior.

The trowel body 10 may be made up of various numbers of individual trowel plates and in the present instance the numeral 13 designates each of three individual trowel plates which overlap along longitudinal portions thereof to form the frustoconical trowel body 10. Various means are known in the prior art for maintaining the diameter of the small leading end of the trowel body while permitting diametral expansion and contraction of the large trailing end thereof. Merely by way of example, the trowel plates 13 of the illustrated embodiment are pivoted to each other as at 14 to permit relative intersliding movement of the trowel plates whereby they are free to move outwardly or inwardly at the large end of the trowel to increase or decrease the vertex angle of the frustoconical trowel body 10.

Figure 2:
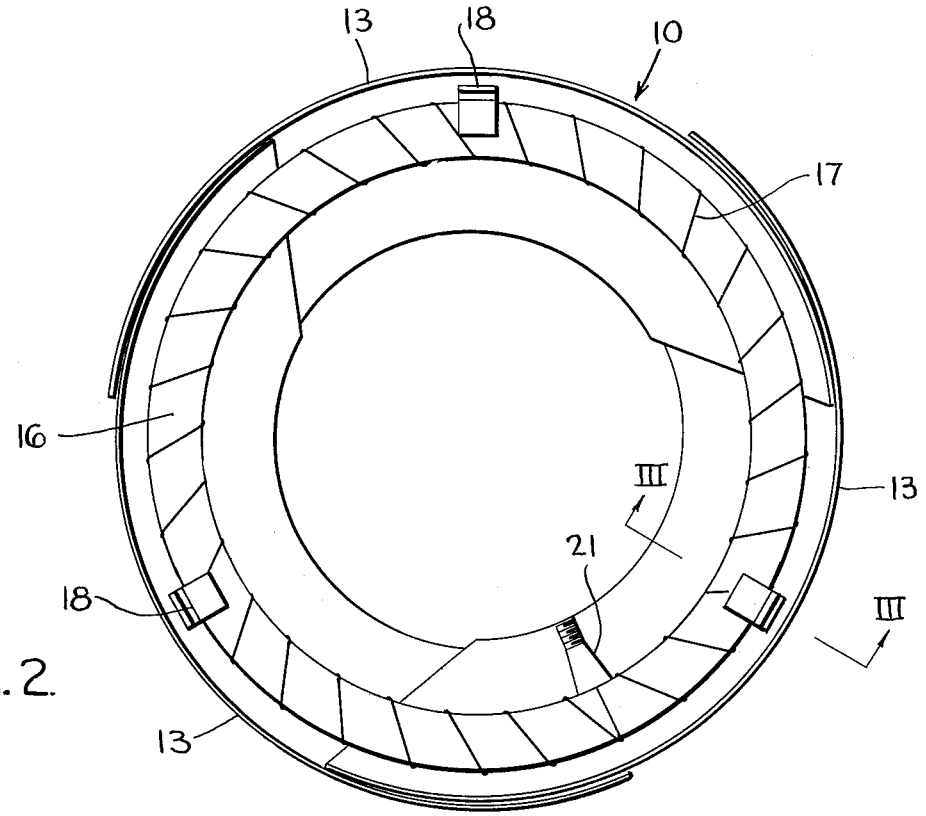
FIG. 2 is an end elevational view of the trowel of FIG. 1 viewed from the large or trailing end thereof and illustrating one form of the expanding means of the present invention.

FIG. 2 is a view looking into the large trailing end of the trowel body illustrated herein by way of example and the numeral 16 designates a hollow torus of elastic rubber or other elastomeric material which exerts resilient radially outward pressure against the interiors of the trowel plates at their large ends to urge the large end of the trowel body into troweling engagement with the mortar in the pipe being lined. The elastic torus 16 is restrained against any substantial increase in its cross-sectional diameter whereby fluid pressure within the torus causes it to expand in the direction of its circumference and thus applies a resilient diameter expanding force within the large end of the trowel.

Figure 3:
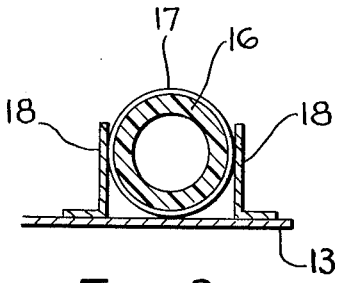
FIG. 3 is a cross-sectional view taken approximately on the line III—III of FIG. 2.

To prevent the aforesaid expansion of the cross-sectional diameter of torus 16 the same may be provided with a helical wire winding 17 substantially throughout its length or circumference. In the drawing the winding 17 is shown merely schematically and the windings may be much more closely spaced than is illustrated to provide the necessary constraint against expansion of the cross-sectional diameter of torus 16. In the present instance angle clips 18 are spot welded to the interiors of the trowel plates 13 at their large ends to locate torus 16 in an axial direction and prevent displacement thereof as clearly illustrated in FIG. 3.

Figure 4:
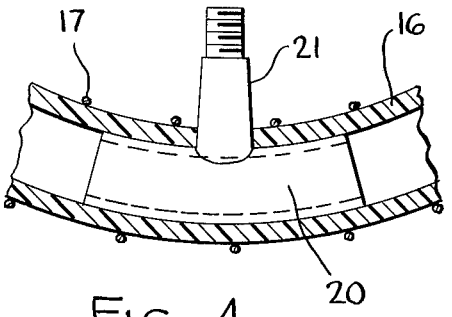
FIG. 4 is a fragmentary cross-sectional view taken in a circumferential direction through a portion of the trowel expanding means of FIG. 1.

As shown in FIG. 4 the torus 16 may be formed by connecting the opposite ends of an elastic tubular member and in the illustrated instance such opposite ends are fitted over an arcuate nipple 20 which is provided with a one-way check valve in the form of an ordinary automotive tire valve 21. The ends of the elastic tubular member may be cemented to nipple 20 and in the basic form of the present invention internal fluid pressure may be provided within torus 16 by way of valve 21.

Figure 5:
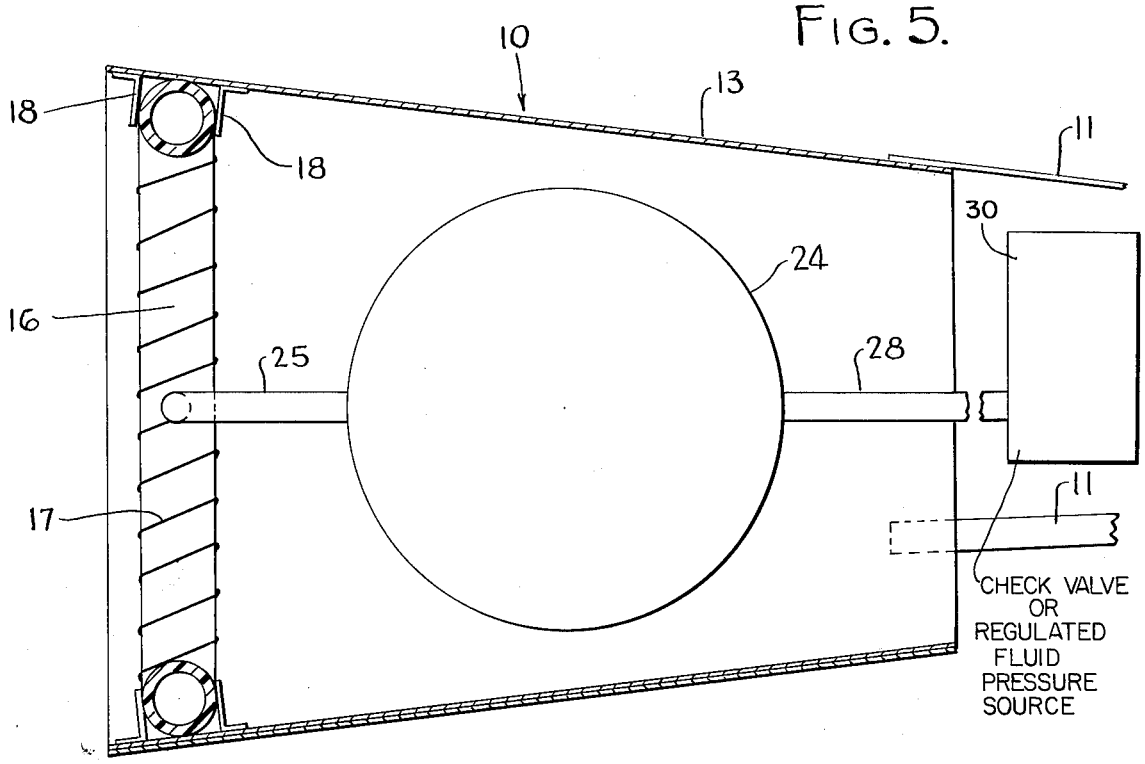
FIG. 5 is a longitudinal cross-sectional view through a trowel body similar to that of FIGS. 1 and 2 showing a modified arrangement of the trowel expanding means of the present invention.
Figure 6:
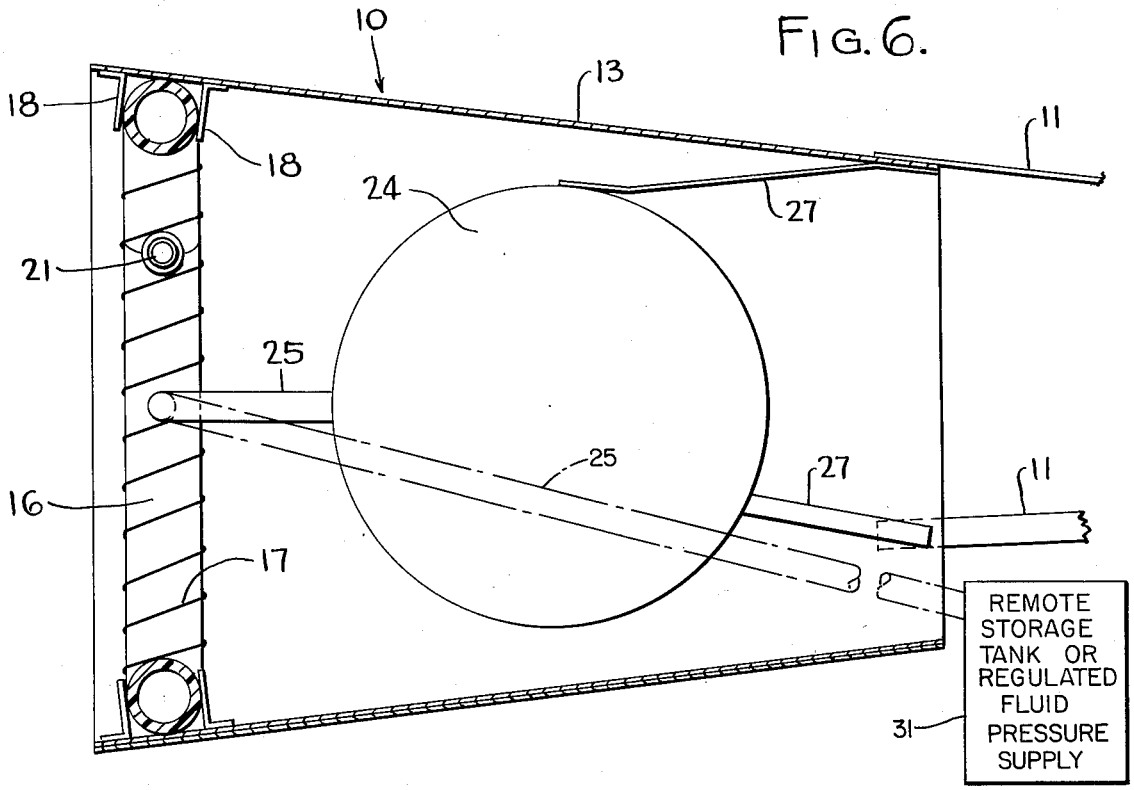
FIG. 6 is a view similar to FIG. 5 showing a still further modified trowel expanding arrangement.

Due to the relatively low internal volume of torus 16 the internal unit pressure therein may drop more sharply than is desired when such internal volume increases due to expansion of the large end of the trowel. To reduce this tendency an auxiliary chamber in the nature of a surge chamber may be provided. In the embodiments of FIGS. 5 and 6 reference numerals corresponding to the reference numerals employed in the embodiment of FIGS. 1 through 4 are applied to corresponding parts.

In the embodiment of FIG. 6 a hollow spherical tank or reservoir 24 is provided with its interior in open fluid connection with the interior of torus 16 by way of a conduit 25. Of course the tank 24 may be of any desired shape. If desired, the tank member 24 may be supported within the trowel as by means of rods 27 which connect with the small end of the trowel as shown in FIG. 6. It will be seen that tank 24 in effect greatly multiplies the effective internal fluid volume and thus greatly reduces the drop in pressure in the torus when the same expands in a lengthwise direction.

FIG. 5 shows a still further variation of the basic arrangement of the present invention. In FIG. 5 the valve valve 21 of torus 16 may be omitted and a conduit 28 leads from the interior of storage tank 24 outwardly of the forward end of the trowel 10 and may lead to a point above the surface of the ground where it may be provided with a check valve for periodically applying fluid pressure to the system or it may be connected with a source of fluid pressure which includes an adjustable pressure regulator, all as indicated at 30 in FIG. 5, so that the internal pressure of torus 16 may be maintained at a desired constant level despite increases or decreases in its diameter due to adjustments in the diameter in the large end of the trowel.

As a further alternative, the auxiliary tank 24 of the embodiment of FIG. 6 may be omitted and the conduit 25 may extend continuously, as shown in dot and dash lines in FIG. 6, to an above ground fluid pressure source which may include a storage tank or a regulated fluid pressure supply as indicated at 31 in FIG. 6.

A preferred embodiment of this invention having been hereinabove described and illustrated in the drawings, it is to be understood that numerous modifications thereof can be made without departing from the broad spirit and scope of this invention as defined in the appended claims.

I claim:

1. A trowel for smoothing a layer of plastic material against the interior of a generally cylindrical conduit, said trowel comprising one or more longitudinally extending plates forming a frustoconical trowel body having overlapping portions corresponding to the number of trowel plates, connecting means at the small end of the trowel body constraining the same to a relatively fixed diameter at such small end but permitting diametral expansion and contraction of the trowel body at the large end by relative intersliding movement of said overlapping portions, and resilient expansion means at the interior of the trowel body adjacent to the large end thereof for applying a resilient expanding force thereagainst in substantially all radial directions, said expansion means comprising a hollow torus of elastic material containing a fluid under pressure, and means constraining said hollow torus against substantial expansion of its transverse cross-sectional diameter whereby said pressure fluid exerts a resilient lengthening force within said torus in a circumferential direction to produce yieldable diametral expanding force against the interior of the large end of said trowel body.

2. Apparatus according to claim 1 wherein said torus constraining means comprises a winding of relatively nonelastic strand material extending substantially throughout the circumference of said torus to prevent substantial increase in its transverse cross-sectional diameter under fluid pressure within said torus.

3. Apparatus according to claim 1 wherein said torus has a one way check valve opening toward the interior thereof for supplying pressure fluid to said torus.

4. Apparatus according to claim 1 including a fluid reservoir and conduit means establishing free fluid communication between the interiors of said reservoir and said torus.

5. Apparatus according to claim 4 wherein said fluid reservoir is disposed within said trowel body.

6. Apparatus according to claim 4 wherein said reservoir is located remotely with respect to said trowel body.

7. Apparatus according to claim 1 having a flexible conduit extending from said torus forwardly through the trowel body and to a relatively remote source of pressure fluid for supplying pressure fluid to the interior of said torus.

8. Apparatus according to claim 4 having a conduit extending from said reservoir to a relatively remote source of pressure fluid for supplying pressure fluid to said reservoir and the interior of said torus.

* * * * *